United States Patent [19]

Nakajima et al.

[11] Patent Number: 4,685,498

[45] Date of Patent: Aug. 11, 1987

[54] BARKING MACHINE

[75] Inventors: Junichi Nakajima; Kenji Nakayama; Takeshi Takizawa, all of Shizuoka, Japan

[73] Assignee: Fuji Kogyo K.K., Shizuoka, Japan

[21] Appl. No.: 675,871

[22] Filed: Nov. 28, 1984

[30] Foreign Application Priority Data

| | | | |
|---|---|---|---|
| Feb. 8, 1984 | [JP] | Japan | 59-021421 |
| Feb. 8, 1984 | [JP] | Japan | 59-021422 |
| Jul. 12, 1984 | [JP] | Japan | 59-145705 |
| Jul. 31, 1984 | [JP] | Japan | 59-160967 |
| Oct. 4, 1984 | [JP] | Japan | 59-208841 |

[51] Int. Cl.[4] ..... B27L 1/00

[52] U.S. Cl. ..... 144/208 B; 144/341

[58] Field of Search ..... 144/208 R, 208 B, 208 G, 144/208 J, 340, 341

[56] References Cited

U.S. PATENT DOCUMENTS

| | | | |
|---|---|---|---|
| 1,966,153 | 7/1934 | Thorne | 144/208 B |
| 2,647,548 | 8/1953 | Guettler | 144/208 B |
| 4,295,507 | 10/1981 | Karlsson | 144/208 B |

*Primary Examiner*—W. D. Bray

*Attorney, Agent, or Firm*—Browdy and Neimark

[57] ABSTRACT

A drum barker in which a receiving container is open at the bottom portion thereof, a drum-like rotary member having a number of barking teeth mounted thereto is arranged to partly enter the bottom opening of the receiving container, and the rotary member is rotated in such a state to raise logs loaded in the receiving container while rolling those logs for barking.

17 Claims, 44 Drawing Figures

BARKING MACHINE

FIELD OF THE INVENTION

This invention relates to a barking machine in which a receiving container is open at the bottom portion thereof, a drum-like rotary member having a number of barking teeth mounted to the outer circumference thereof is arranged to partly enter the bottom opening of the receiving container, and the rotary member is rotated in such a state to raise logs loaded in the receiving container while rolling those logs for barking.

BACKGROUND OF THE INVENTION

Heretofore, there is known a barking machine in which logs are supplied to a rotating drum for barking, but the machine of this type has low efficiency and produces very large noises.

There is also known such a barking machine in which a rotary shaft is mounted parallel to and below a log receiving container horizontally mounted to a body frame, a number of beaters are attached to the rotary shaft, and the rotary shaft is arranged causing those beaters to pass slits bored in the bottom of the log receiving container.

This barking machine has higher barking efficiency than the first mentioned machine, but accompanies with several disadvantages as follows. The circumferences of logs are strongly beaten by the beaters, thus resulting in a fear that the woody parts would be damaged and a drive for the beaters would be failed due to strong shocks. When hitting upon logs, the beaters are withdrawn by reaction forces, thus resulting in less rolling and circulation of logs. In particular, logs of heavy weight will not move so that only one part of the log is badly damaged leaving a bark on the remaining part.

SUMMARY OF THE INVENTION

To solve the above mentioned disadvantages, the present invention is characterized in that a container fixed to a body frame for receiving logs is formed with an opening at the bottom portion thereof, rotary members are arranged in parallel below the receiving container causing the top portion thereof to enter the opening of the latter, the rotary members are each provided on the outer circumference thereof with a number of barking teeth each of which has a height gradually increased in the reverse direction of rotation, and logs loaded in the receiving container are rolled while being raised for barking.

BRIEF DESCRIPTION OF THE DRAWINGS

FIGS. 1–17 show an embodiment I in which; FIG. 1 is a plan view of a barking machine, FIG. 2 is a side view of the machine, FIG. 3 is a front view of the machine, FIG. 4(*a*) is a transverse sectional view of the machine, FIG. 4(*b*) is a sectional view showing a rotary member supported by the another type of support means, FIG. 4(*c*) is an elevational view showing a rotary member which is provided on its periphery with a band, FIG. 5(*a*) is a side view, partly sectioned, of a rotary member, FIG. 5(*b*) is a perspective view of another rotary member, FIG. 6 is a view as seen in the direction of arrows A—A in FIG. 5(*a*), FIG. 7 is a rear view of barking teeth, FIG. 8(*a*) is a plan view of the barking teeth, FIG. 8(*b*) is a side view of the barking teeth, FIG. 9 is a rear view of another embodiment of barking teeth, FIG. 10(*a*) is a rear view, partly broken, of barking teeth each having a detachable addendum block, FIG. 10(*b*) is a side view thereof, FIG. 11(*a*) is a rear view, partly broken, of another block type barking teeth, FIG. 11(*b*) is a side view thereof, FIG. 12 is a rear view of tip type barking teeth, FIG. 13 is a side view, partly broken, of an essential part of the barking machine, FIG. 14 is a view as seen in the direction of arrows B—B in FIG. 13 for showing the connection part of a receiving container, FIG. 15 is a rear view of a discharge section, FIG. 16 is a side view of a tilting device for the receiving container, and FIG. 17 is a side view of another tilting device;

FIGS. 20–24 show a barking machine according to an embodiment III in which; FIG. 20 is a transverse sectional view of the barking machine, FIG. 21 is a front view of a rotary member, FIG. 22 is a transverse sectional view showing another example of the receiving container, FIG. 23 is a side view of still another receiving container, and FIG. 24 is a transverse sectional view thereof;

FIGS. 25–30 show an embodiment IV in which; FIG. 25 is a plan view of a barking machine, FIG. 26 is a side view of a part of a rotary member, FIG. 27 is a transverse sectional view of the barking machine, FIG. 28(*a*) is a front view of a barking cutter, FIG. 28(*b*) is a plan view thereof, FIG. 28(*c*) is a plan view of the barking cutter having a different type bite, FIG. 29(*a*) is a perspective view of another barking cutter, FIG. 29(*b*) is a plan view thereof, FIG. 29(*c*) is a transverse sectional view thereof, and FIGS. 30(*a*) and 30(*b*) are transverse sectional views showing a state that a log is loaded in an anomalous attitude; and FIGS. 31–32 show an embodiment V in which; FIG. 31(*a*) is a transverse sectional view of a barking machine, FIG. 31(*b*) is is a transverse sectional view of a pressing member, and FIG. 32 is a transverse sectional view of another example.

DETAILED DESCRIPTION OF THE INVENTION

Embodiment I

Figure 1:
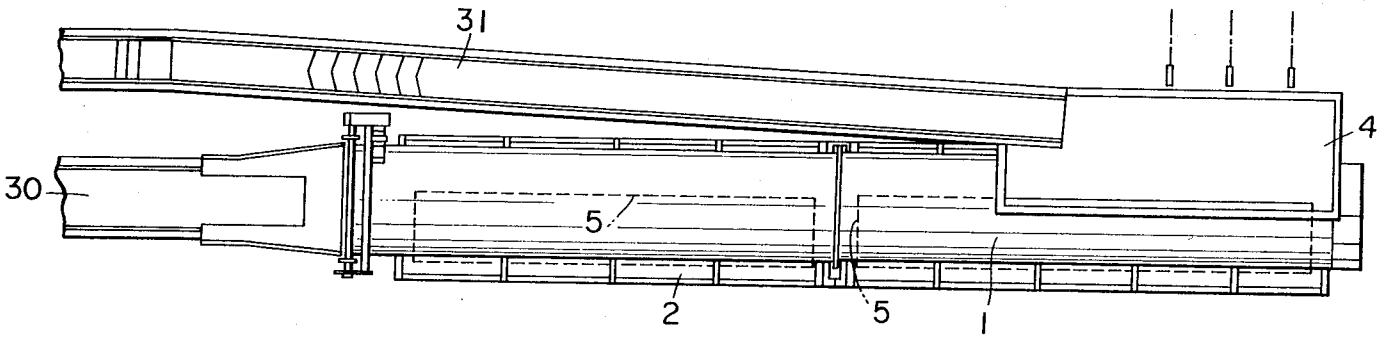

Referring to FIGS. 1–17, designated at reference numeral 1 is a log receiving container (hereinafter referred to as receiving container) which is horizontally mounted to a body base 2 while being lowered or inclined toward the feeding-out side. Two units of receiving containers are connected in series, each of which has an opening 3 bored at the bottom portion thereof to extend substantially over the entire length, and a hopper 4 laterally projecting is attached to a loading inlet provided on the upstream side of receiving container 1 at the leading end thereof. The receiving container 1 may be composed of left and right side plates arranged to widen upwardly into a V shape, and front and rear end plates. In this case, the hopper 4 is similarly provided above the receiving container on the leading side.

Figure 5A:
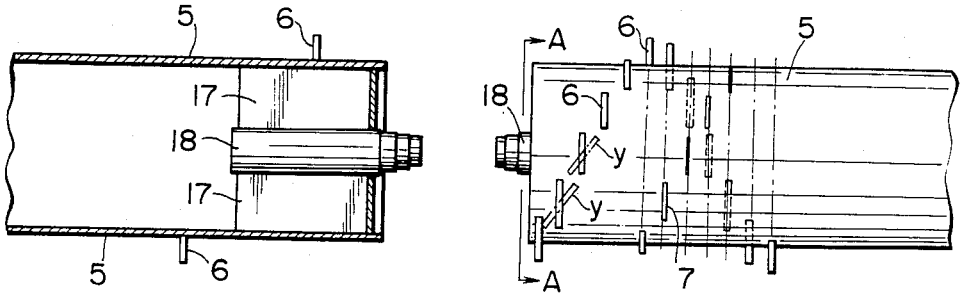
Figure 5B:
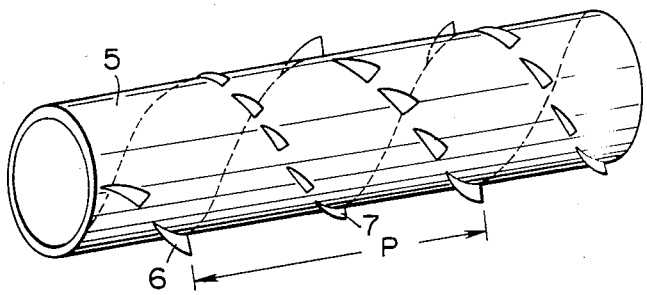
Figure 6:
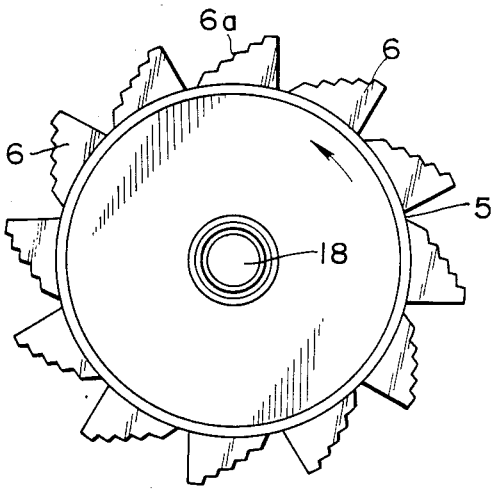

The opening 3 of the receiving container 1 is displaced, as viewed in the lengthwise direction thereof, from the vertical center line of the receiving container 1 transversely (toward the side opposite to the hopper 4). A drum-like rotary member 5 (standard radius of 730 mm) is rotatably supported below the receiving container such that the top portion of the former enters the opening 3 of the latter. The rotary member 5 includes on the outer circumference thereof a number of high barking teeth 6 having saw-like bits 6*a* (a representing a locus of rotation thereof) and welded or bolted to the rotary member in the spiral form, the barking teeth 6 each having a height gradually increased in the reverse direction of rotation. With an arrangement that barking teeth 7 having a $\frac{1}{2}$–$\frac{2}{3}$ height of the barking teeth 6 are arranged midway a train of the barking teeth 6 in the spiral form with the same lead angle as that of the barking teeth 6, as shown in FIG. 5(*b*), when a bent log is obliquely placed on the rotary member 5, the log is barked by the low barking teeth 7 at both ends thereof and by the high barking teeth 6 at the intermediate part thereof as seen from the figure, and when only one end of a log is placed on the high barking teeth 6, its intermediate part is barked by the low barking teeth 7. In order to carry out such barking, the pitch P of the respective teeth trains (2400 mm at standard) is set substantially equal to or slightly shorter than the length of log.

For example, in case of a forming the barking teeth 6 and 7 with a plate material of 22 mm thickness, the higher barking teeth 6 are set to take the highest portion of 100 mm–120 mm and the lower barking teeth 7 are set to take the highest portion of 50–60 mm or 67–80 mm.

Figure 7:
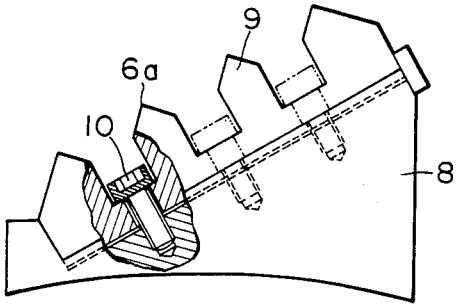
Figure 8:
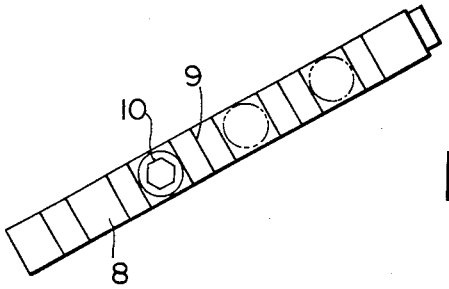
Figure 8:
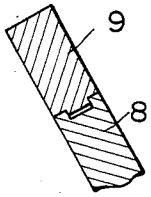
Figure 9:
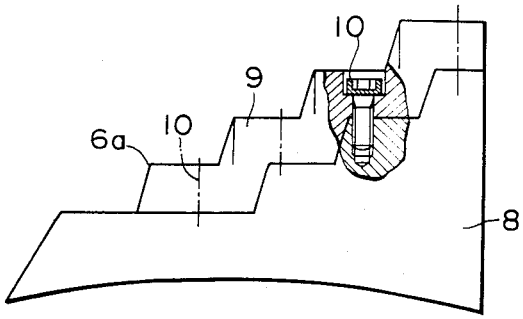
Figure 10:
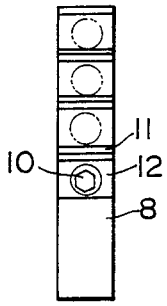
Figure 10:
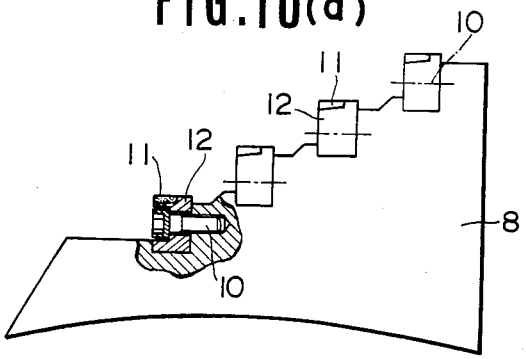
Figure 11B:
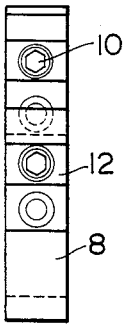
Figure 11A:
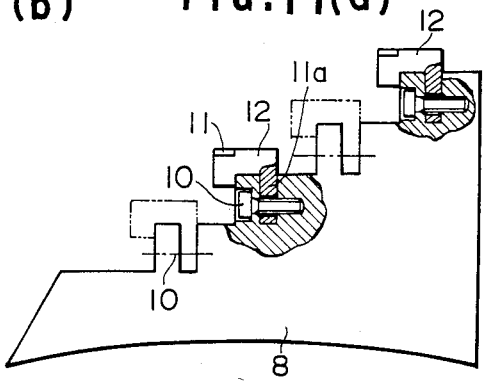
Figure 12:
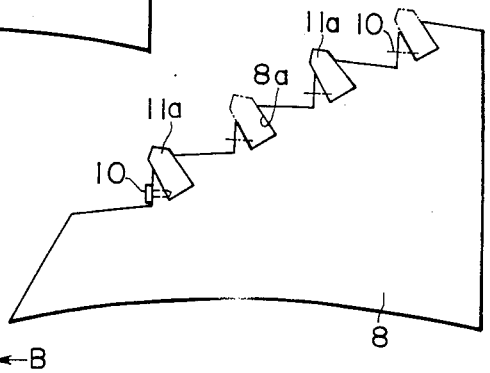

The barking teeth 6, 7 are soon abraded even when they are formed of steel materials of high hardness or subjected to hardening treatment. Therefore, the barking teeth 6, 7 are preferably mounted as follows. As shown in FIGS. 7, 8(*a*) and 8(*b*), a base plate 8 is welded to the rotary member 5 and an addendum plate 9 including a number of bits 6*a* is detachably screwed thereto using a plurality of bolts 10. Alternatively, as shown in FIG. 9, a base plate 8 having the stepped upper surface is welded to the circumference of the rotary member 5, and a set of addendum plate 9 having the stepped upper and lower surfaces is fitted to the base plate 8 in a socket and spigot relation and then detachably screwed thereto using a plurality of bolts 10. Alternatively, as shown in FIG. 10, a base plate 8 is formed into the same shape as that of the barking teeth 6, 7, and blocks 12 integrally provided with addendum tips 11 of high hardness are fitted to cut-out recesses in the stepped portions of the base plate 8 and then detachably screwed thereto by means of bolts 10. Alternatively, as shown in FIG. 11, a groove is bored in each stepped portion of the base plate, and a block 12 having an addendum tip 11 is fitted at a leg part 11*a* thereof to the groove and then detachably screwed thereto. And alternatively, as shown in FIG. 12, a tapered cut-out groove 8*a* having a narrower width at the distal end portion is bored in each angled corner of a base palte 8, and a tapered addendum tip 11*a* is fitted to the cut-out groove 8*a* and then detachably screwed thereto by means of a bolt 10. Any of such arrangements ensures easy replacement of each addendum when it has been worn, and can improve the barking efficiency for a short time at the reduced cost.

Furthermore, if it is so arranged that all or a part of the barking teeth 6, 7 are inclined, as shown by chain lines Y in FIG. 5, for the tailing side (higher side) of each tooth to deviate toward the forward side in the direction of traveling of logs, the logs are promoted in their movements.

On the other hand, in case that it is difficult to bark depending on the kinds of logs, cutting period or from other reasons, or that there is a small amount of logs, a barker is prefereably operated in a batch mode to prolong a barking time by raising a shutter 13 provided at a discharge outlet 1*c* of the backward receiving container 1 by means of a motor 14 through a chain 15, thereby blocking discharge of logs. In this case, the barking teeth 6, 7 near the discharge outlet 1*c* are preferably deviated for the leading side thereof in the direction of rotation toward the discharge outlet 1*c* in an opposite manner to the above, so that the inversely deviated barking teeth 6, 7 push back the logs moving toward the discharge outlet 1*c*. As a result, the logs are uniformly dispersed without being accumulated only in the vicinity of the discharge outlet 1*c*, thus ensuring good barking.

A lower part 1*a* of the receiving container 1 on one side (the side where the barking teeth 6, 7 enter the receiving container 1 while rising) is inclined downwardly from a position opposite to the uppermost portion of the rotary member 5 to a position substantially equal to a level of the axis, while a lower part 1*b* thereof on the other side is descended while curving at a slight inclination to a location somewhat spaced outwardly from the vertical diameter of the rotary member 5. The lower part 1*a* on one side and the lower part 1*b* on the other side are both formed at the lower edges thereof with slits 16 for passage of the barking teeth 6, 7, so that the barking teeth 6, 7 enter the receiving container 1 through the slits 16 formed in the steeply inclined lower part 1*a* on one side and then go out through the slits 16 formed in the lower part 1*b* on the other side.

Figure 4:
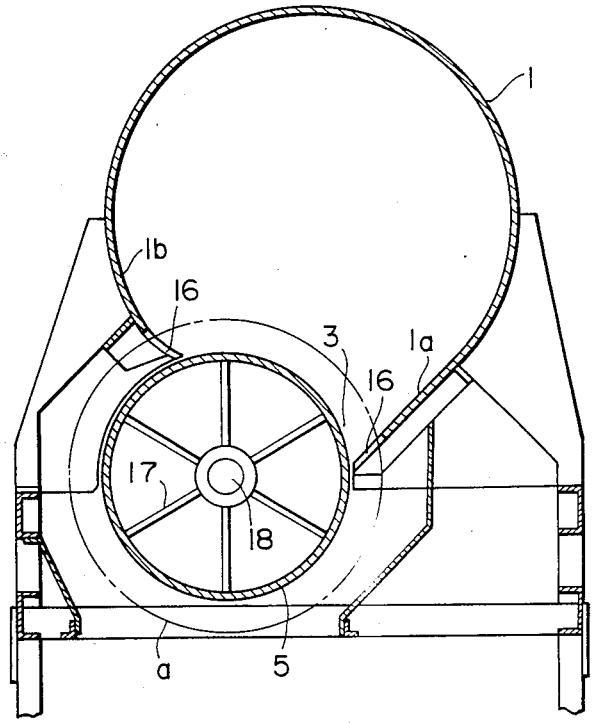
Figure 4:
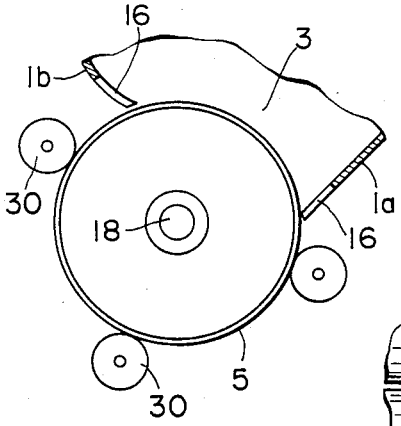
Figure 4:
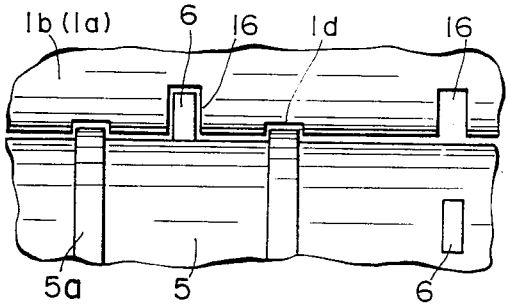
Figure 13:
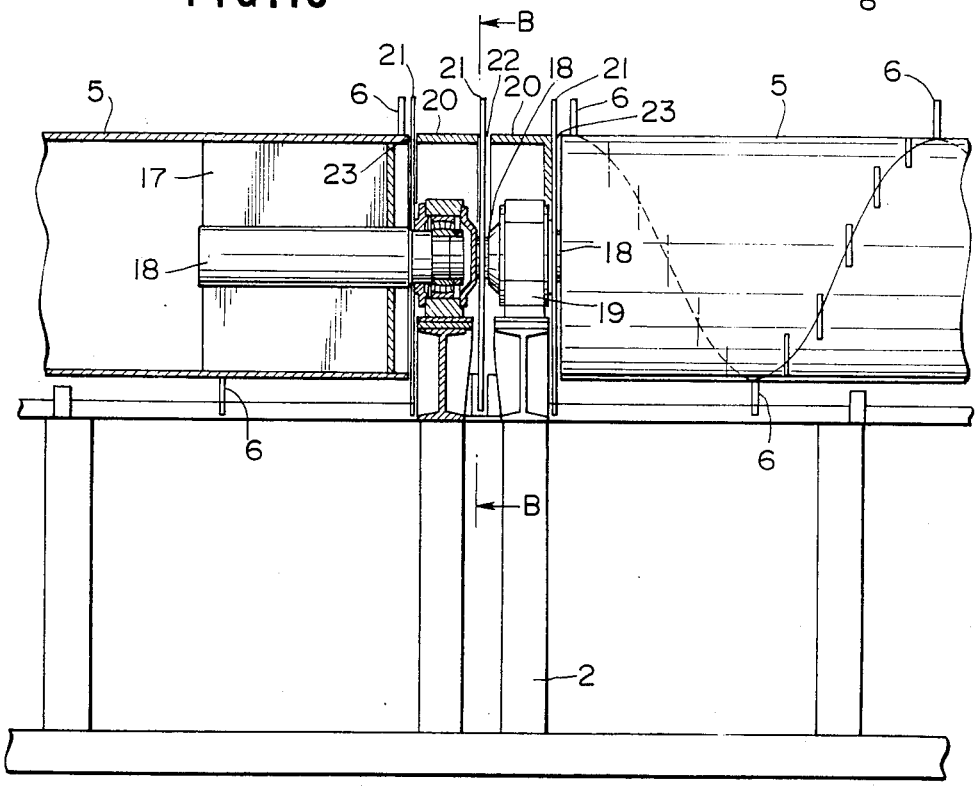
Figure 15:
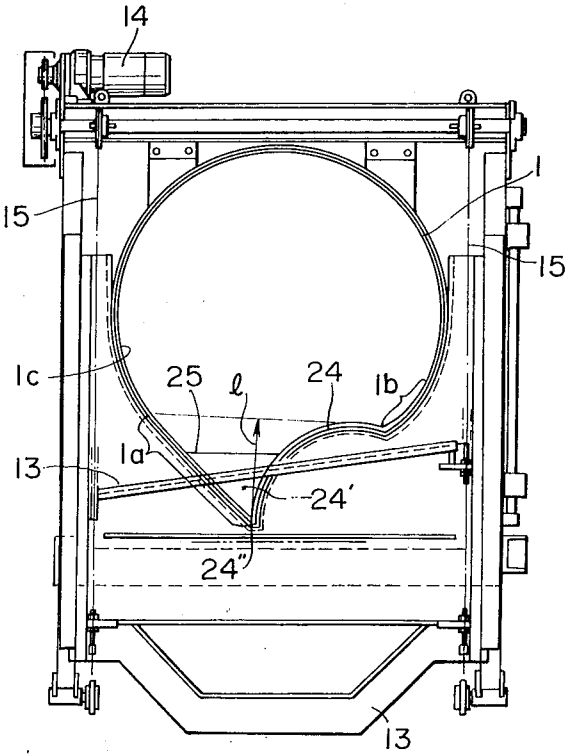
Figure 14:
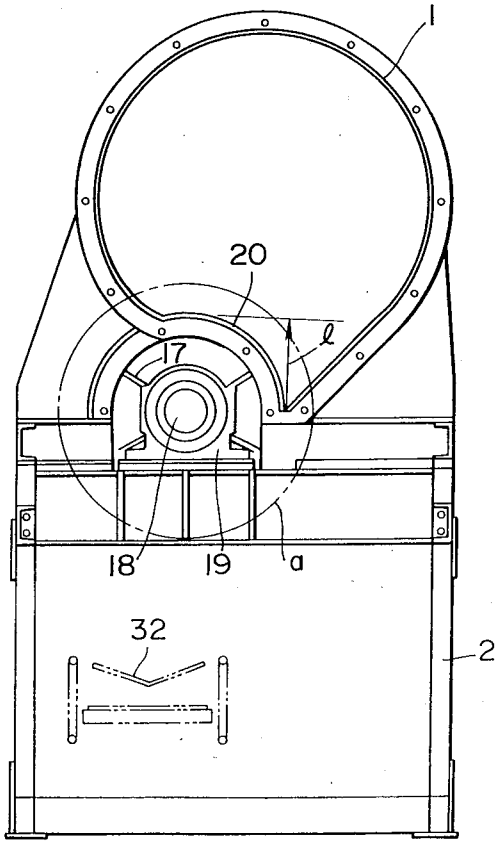

Fixed to the inner circumference surface at each end of the rotary members 5, 5 longitudinally connected to each other, as shown in FIGS. 4, 5 and 13, is a shaft 18 through which a plurality of rectangular plates 17 are radially arranged as seen in the axial direction, the shaft 18 being rotatably supported to the body base 2 by a bearing 19. As shown in FIGS. 13 and 14, the upper portion between the rotary members 5 and 5 is covered with a circular cover 20 having the outer circumference in alignment with that of each rotary member 5. Fixed to both the shafts 18, 18 at positions near the receiving containers 1, 1 and the projected portion of either one shaft 18 are barking discs 21 each having a plurality of teeth similar to the barking teeth 6 formed on the outer circumference thereof in such a manner that the barking disc 21 fixed to the projected end of either one shaft 18 is projecting upwardly through a slit 22 bored in the cover 20, and the barking discs 21, 21 near the rotary members 5, 5 are projecting through gaps 23, 23 between the cover 20 and the rotary members 5, 5 whereby logs are barked while being promoted in the movement thereof from one receiving container 1 to another receiving container 1.

Figure 2:
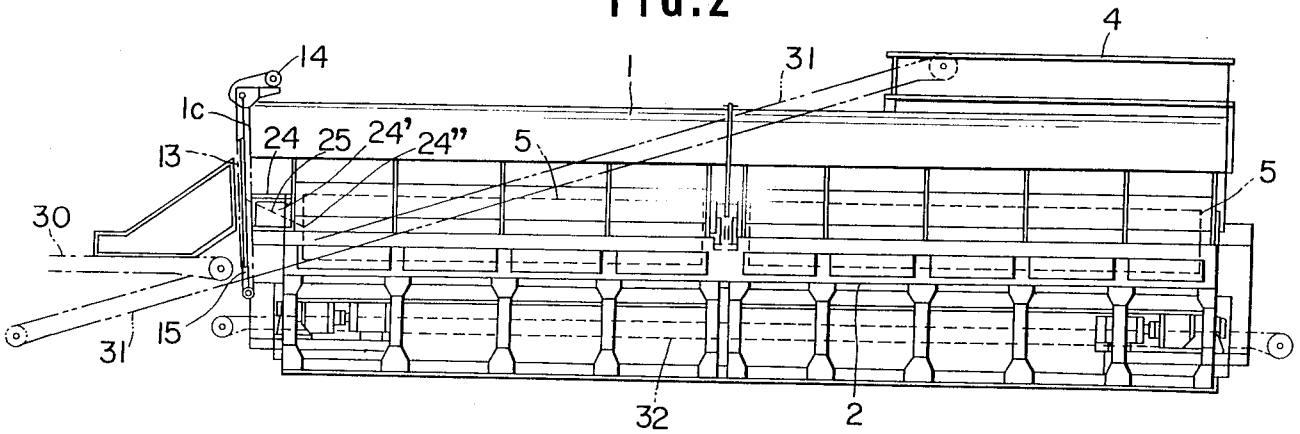
Figure 3:
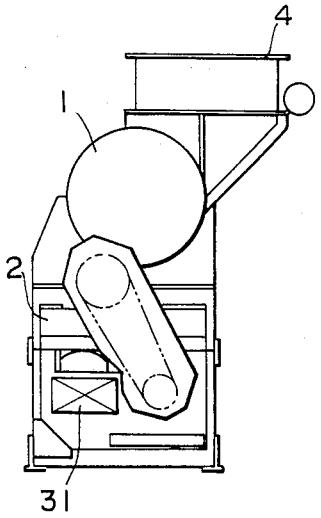

Although a cover 24 provided at the discharge side of the rotary member 5 has the same shape as that of the cover 20 as seen in the axial direction, a guide plate 25 is welded to a lower recessed part 24' of the cover 24, which guide plate is, as seen from side, fitted at its leading end into a bottom part 24'' of the recessed part 24' and raised up at its tailing end to a level corresponding to a $\frac{2}{3}$ position of the depth l of the bottom part as shown in FIG. 2 by a chain line, and which is triangular as seen from above, so that the discharged timbers will not be erected by striking at the leading ends thereof against the bottom part 24'' and can be smoothly discharged out in turn while being slidably guided.

When interconnecting two receiving containers 1, 1 in series, if the shafts 18, 18 are supported by the bearings 19, 19 at the connection between the rotary members 5 and 5, a spacing between the rotary members 5 and 5 is increased and hence the width of the cover 20 must be enlarged, as a consequence of which the barker is increased in its entire size and the movement of logs toward the downstream receiving container 1 becomes less smooth correspondingly. In this respect, reinforcing plates or rods are welded at each end of the rotary members 5, 5 and, as shown in FIG. 4(*b*), the circumference of the end is supported by rollers 30 from at least three directions, thus making it possible to support the rotary members 5, 5 with their ends more close to each other. In other words, the cover 20 can be formed to have narrower width enough to cover two rows of rollers 30, thereby resulting in the reduced entire length of the barker and the smooth transfer of logs.

There is a possibility that a wood piece such as a backboard may bite into a gap between the lower edge of the lower part 1*b* on the other side of the receiving container 1 and the outer circumference of the rotary member 5, as well as the slits 16. As shown in FIG. 4(*c*), therefore, bands 5*a* are fitted round the rotary member 5 at locations corresponding to midway the slits 16, 16 and the outer circumference of each band is brought into slide contact with the lower edges of both lower part 1*a* on one side and lower part 1*b* on the other side, or each band 5*a* is made thicker than a gap between the aforesaid lower edges and the outer circumference of the rotary member 5 and a part of the band 5*a* is caused to fit into a shallow slot 1*d* formed in the lower edges, thereby surely eliminating the occurrence of such a biting phenomenon.

Figure 16:
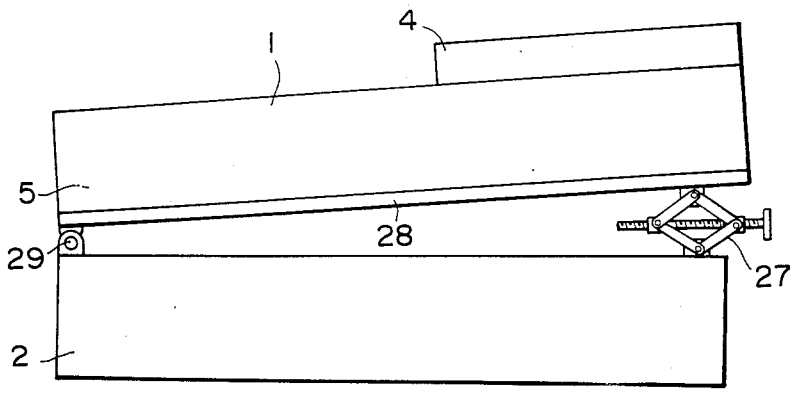
Figure 17:
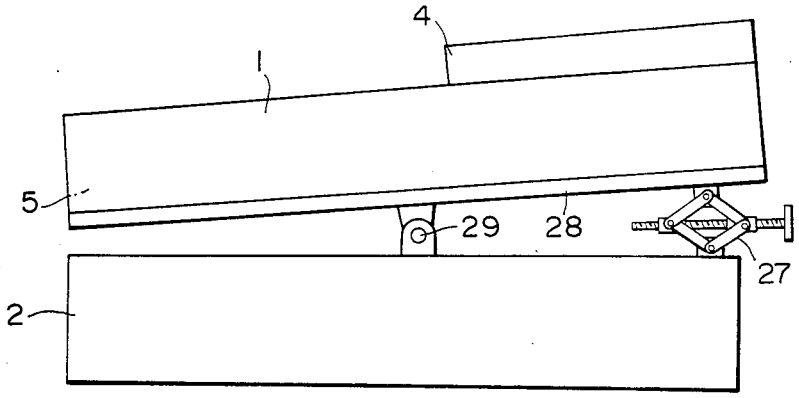

Although in this embodiment the receiving containers 1, 1 are fixed to the body base 2, such an arrangement is also possible that, as shown in FIG. 16 (showing the upstream side only), the motors, rotary members 5, bearings 19, etc. of each receiving container 1, 1 are mounted on a tilting base 28, the connection side of the tilting base 28 is vertically tiltably supported by a support shaft 29, the leading portion of the tilting base 28 on the upstream side is supported by a jack 27 to be adjustable in rising and falling, and the tailing end and the bearing 19 of the receiving container 1 on the downstream side is supported by another jack 27 to be capable of rising and falling. With this arrangement, an inclination angle of the receiving containers 1, 1 can be adjusted depending on the difference in difficulty of barking due to the cutting period and kinds of logs, or the difference in mobility of logs due to variations in diameter thereof, thus making it possible to prevent insufficient barking or damage of logs resulted from excessive barking. In still another embodiment, the barking machine may be tiltable with the fulcorum at an intermediate portion, as shown in FIG. 17.

In the barking machine as mentioned above, when logs are loaded from the hopper 4 into the receiving container 1 by means of a loading conveyor or lift, the barking teeth 6, 7 enter the receiving container 1 through the slits 16 formed in the steeply inclined lower part 1*a* on one side of the receiving container 1 to bark the logs while pushing up them toward the other side, during which time the rotary members are rotated while supporting the logs. When the barking teeth 6, 7 reach the lower part 1*b* on the other side, they go out through the slit 16 on that side. At this time, preceding logs are pushed by the subsequent logs to ride over the lower part 1*b* on the other side and, simultaneously, sprung up by the barking teeth 6 to roll toward the lower part on one side. During that time the log is subjected to the above mentioned barking process as seen from FIG. 5(*b*) and then returned back to the lower part 1*a* to be barked once again.

When logs come over the cover 20 at the tailing end of the receiving container 1 on the upstream side, they are smoothly transferred to the receiving container 1 on the downstream side for similar barking, because the barking discs 21 serve to promote the movement of logs while barking them.

Such an arrangement, in which the barking teeth 6 in the downstream barking section dispose near the discharge outlet are reduced in their height to be comparable with the barking teeth 7, or their bites 6*a* are made smaller, ensures finish barking to remove the remaining bark without damaging the woody parts. After such barking process, the logs are discharged out through the discharge outlet 1*c* while being guided by the cover 24 and the guide plate 25, and then fall on a discharge conveyor 30 where they are selected so that those logs having barks left thereon are placed on a return conveyor 31 to be fed back to the hopper 4 for re-treatment.

Furthermore, the removed barks fall through between the slits 16 as well as rotary members 5 and the receiving container 1 onto a conveyor 32 stretched in the lower section to be thereby transported out.

When the barking teeth 6, 7 have been worn as a result of such repeated barking operation, they can be replaced by new ones in accordance with any of the arrangements shown in FIGS. 7–12, whereby the barking efficiency is greatly improved by simple operation.

Embodiment II

Figure 19:
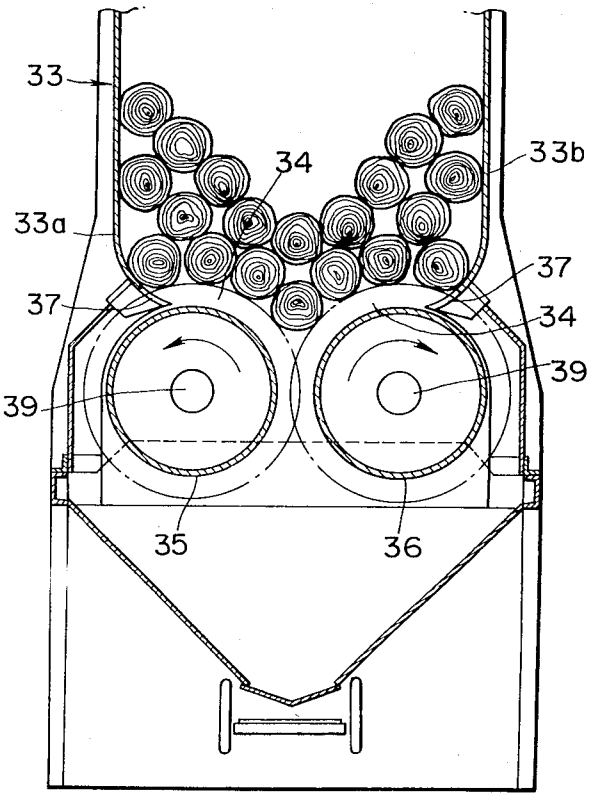
FIG. 19 is a transverse sectional view of another double-drum type barking machine.
Figure 18:
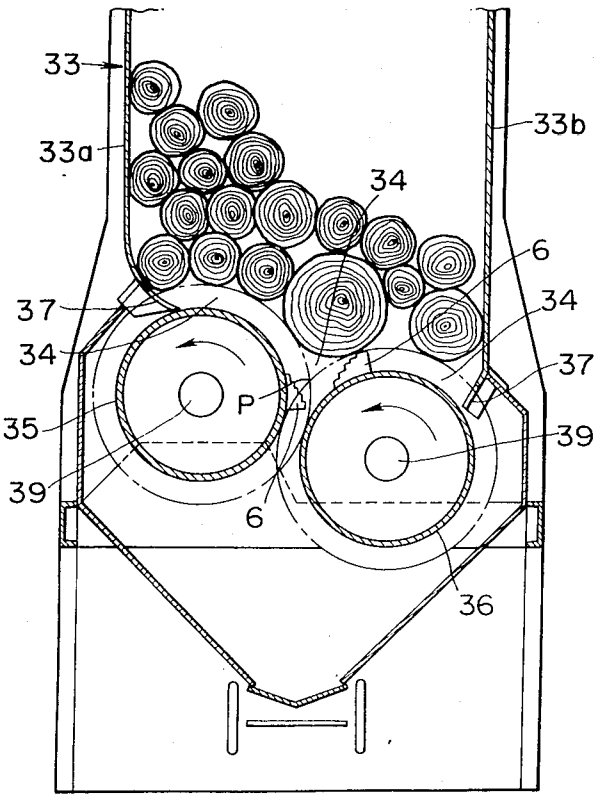
FIG. 18 is a transverse sectional view of a barking machine according to an embodiment II in which rotary members are arranged in parallel.

Referring now to FIGS. 18 and 19, designated at reference numeral 33 is a receiving container which is widely open at the top and bottom portions thereof substantially over the entire length, and which is somewhat inclined such that the discharge outlet side at its tailing end becomes lower than the loading inlet side at its leading end. Below an opening 34 at the bottom portion, there are rotatably supported a pair of rotary members 35, 36 comprising parallel drums with one member being positioned higher than the other member, the top portions of which are caused to enter the receiving container 33 through the opening 34. The lower part of one side plate 33*a* is descended while curving toward a position somewhat spaced outwardly from the vertical diameter of the higher rotary member 34, so as to approach the outer circumference of the rotary member 34, whereas the lower part of the other side side plate 33*b* is inclined (or curved) toward a position at a higher level than the horizontal diameter of the rotary member 36 on the same side, so as to approach the outer circumference of the rotary member 36. Fixed to the outer circumference of each of the rotary members 35, 36 are a number of barking teeth 6 each having a plurality of bites and a height gradually increased in the reverse direction of rotation, which are arranged in the spiral form similarly to the embodiment I. Assuming that a spacing between every two adjacent barking teeth 6 (formed of a plate material 19 mm thick) is 100 mm, the rotation locus a of the barking teeth 6 of one rotary member 35 is deviated by 50 mm relative to the rotation locus b of the barking teeth 6 of the other rotary member 36. Stated differently, the rotary members 35 and 36 are supported to be close to each other, as shown in FIG. 18, such that the barking teeth 6 projected on one rotary member 35 pass between rows of the rotation locus b of the barking teeth 6 projected on the other rotary member 36, with the section above the crossing point p of both rotation locuci a and b forming a V shape. A number of slits 37 are bored at the lower ends of the respective side plates 33*a*, 33*b* of the receiving container 33 for passage of the barking teeth 6.

Short shafts 39, 39 are welded to both ends of each of the rotary members 35, 36 through a number of rectangular plates radially arranged, the shafts 39, 39 being at their outer ends supported to the mody base by respective bearings. A pulley mounted to either one shaft 39 is driven by a pulley of a motor. On this occasion, the higher rotary member 35 is rotatably driven at a higher speed than the lower rotary member 36, so that any log will not be bitten at the rotation locus p.

In the above mentioned double-drum type barking machine, when a number of logs are loaded on the leading side of the receiving container 33 with the rotary members 35, 36 being rotatably driven for the top portions thereof to move toward one side plate 33*a*, they are first barked while being pecked and sent leftwardly by the barking teeth 6 of the lower rotary member 36, and then smoothly transferred to the rotary member 35 rotating at a higher speed in a higher position where they are pushed up obliquely upwardly while being barked by the barking teeth 6 thereof, as shown in FIG. 18. After undergoing such barking process, the logs are returned back to the lower rotary member 36 for subsequent barking.

During the above barking process, it is a matter of course that logs of larger diameter, along with small diameter logs, will not fall through between the rotary members 35 and 36, because they are held by the barking teeth 6 of either one rotary member 35 or 36 at a location where the rotation loci a and b of the respective barking teeth 6 provides a V-shaped space. On the other hand, if the barking teeth of the left and right rotary members 35, 36 are set to have the difference of 180 degrees in their phases, the removed bark pieces may easily fall through a gap between the circumferences of both rotary members 35, 36 so as to be then discharged out.

When transferring from the lower rotary member 36 to the higher rotary member 35, each log of large diameter is pecked at one side thereof downwardly obliquely by the barking teeth 6 of the lower rotary member 36 and at the other side thereof upwardly by the barking teeth 6 of the higher rotary member 35, so that the large diameter log may be very satisfactorily rolled to surely bark the complete circumference thereof, although it has heavy weight and is not susceptible to roll. Moreover, the large diameter log is smoothly transferred to the higher rotary member 35 by a combination of the facts that it is pushed against the higher rotary member 35 by the barking teeth 6 of the lower rotary member 36, that the subsequent log is pushed into under the concerned large diameter log by the barking teeth 6 of the lower rotary member 36, and that the higher rotary member 35 is rotating at a higher speed than the lower rotary member 36, whereby it can be circulated in a state comparable to logs of average diameter and hence barked with high efficiency.

FIG. 19 shows another double-drum type barking machine in which logs are barked while being pecked up leftwardly and rightwardly. This barking machine is similar to the above mentioned embodiment in structure of the rotary members 35, 36 and the barking teeth 6 themselves, but different in that the rotary members 35, 36 are arranged at an equal level.

In case logs to be barked have all a standard diameter and large diameter ones are not included, when the rotary members 35, 36 are rotated in the opposite directions such that the barking teeth 6 of the respective rotary members are both turned upwardly at a location where the rotation loci of the barking teeth 6, 6 are overlapped with each other, when looked at from front as shown in the FIG. 19, the logs are scratched up toward the side plates 33*a*, 33*b* while being barked by the barking teeth 6, 6, and then fall to the central section, whereupon circulation is repeated. Because the barking teeth 6 are all turned upwardly at a location between the rotary members 35 and 36, any log will not fall therebetween. Moreover, even when an amount of logs pushed up by the left and right rotary members 35, 36 is not uniform, they are adequately distributed to the left and right in response to the then existing situation at the time when they have been returned back to the center, thereby ensuring rational barking process.

In case of including large diameter ones among logs loaded into the receiving container 33, by rotating the left and right rotary members 35, 36 in the same direction, it becomes possible to satisfactorily bark even those large diameter logs while rolling and circulating them in a desired fashion, similarly to the arrangement as shown in FIG. 18.

Embodiment III

A barker of this embodiment is suitable to bark elongated logs such as timbers for building. Designated at 41 is a receiving container which is substantially horizontally mounted to a body base 42, and which is formed to take a length less than two times the length of logs lumbered into pillar or plate timbers, preferably to take a length larger than that of logs in order of $\frac{1}{3}$–1/5 thereof. The receiving container 41 is formed at the bottom portion thereof with an opening 43 extending substantially over the entire length, and at the top portion thereof with a hopper open upwardly.

Figure 20:
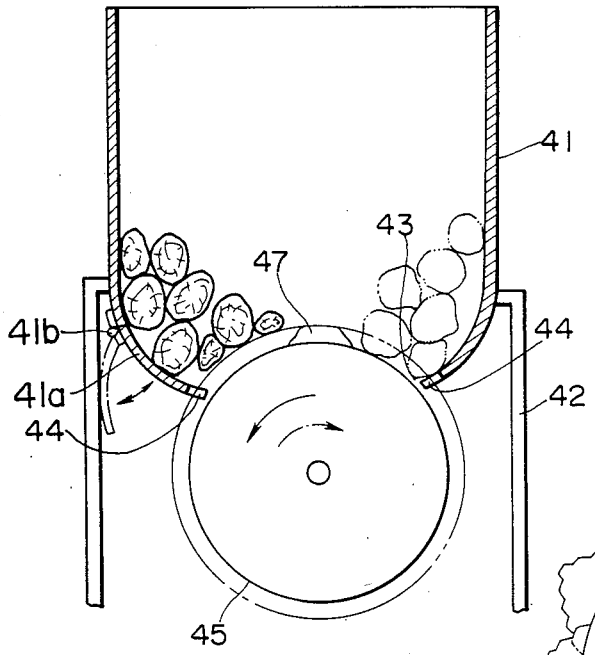

As shown in FIG. 20, the lower parts of side walls of the receiving container 41 are transversely symmetrical when looked at in the lengthwise direction, and are gradually curved to make narrower a spacing therebetween so as to provide the opening 43. The opening 43 includes a number of cut-out recesses 44 for passage of later-described barking teeth 47 therethrough.

A rotary member 45 is constituted into the form of a drum and rotatably supported causing the top portion thereof to enter the opening 43. Mountain-like barking teeth 47 each having a height gradually reduced in both the forward and backward directions of rotation are welded to or detachably screwed by means of bolts to the outer circumference of the rotary member 45 in the spiral form. Each of the barking teeth 47 has saw-like bits 47*a* engraved at the outer edge thereof.

As shown in FIG. 20, the barking teeth 47 are each inclined when looked at in the direction normal to the axis of the rotary member 45, and they enter the receiving container 41 through the cut-out recesses 44 on one side and then go out to the outside through the cut-out recesses on the other side.

The rotary member 45 is rotataly driven by a motor, which is rotatable in both the forward and backward directions, causing logs to reciprocate in the lengthwise direction while barking them. Such forward and backward rotations are switched over automatically or manually so that the motor is immediately turned forwardly or backwardly after it has been once stopped.

The lower part of side wall of the receiving container 41 is formed as an openable plate 41*a*, which is screwed at either lower or upper end thereof so that it may be opened after barking process to smoothly discharge the lumbered logs.

In the foregoing barker, when a number of elongated logs for lumbering are loaded into the receiving container 41 through the top opening by means of a loading conveyor or forklift with the rotary member 45 rotating in either one direction, the barking teeth 47 enter the receiving container 41 through the cut-out recesses 44 in the lower part of the receiving container 41 on one side and then go out through the cut-out recesses 44 on the other side, during which time the bits 47*a* on the forward side in the direction of rotation serve to push up and bark the loaded logs toward the other side while rolling them and, after passing the top of the barking teeth 47, the logs are barked while being descended by the downwardly inclined bits 47*a* on the backward side in the direction of rotation.

Reaching the other side from one side, the preceding logs are pushed up by the subsequent logs in turn to roll now back to one side, so that barking process is completed by repeating such a circulation.

During that recirculation, the deviated plate surfaces of the barking teeth 47 function to shift the logs little by little in the lengthwise direction thereof. When the end faces of logs and projections such as corugated bark surfaces or knots strike against the barking teeth at the forward surface in the direction of rotation. Finally, the end faces of most logs come to abut with the end wall of the receiving container 41.

At that time, the motor 46 is switched off to stop the rotary member 45 and then reversely turned to rotate the rotary member 45 also in the backward direction. Because of the mountain-like barking teeth 47, the opposite inclined bits now bark the logs while pushing them and the opposite deviated plate surfaces function to move the logs in the reverse direction, so that the opposite end faces of logs come to abut with the other end wall of the receiving container 41. At that time, the motor 46 is again reversed in the direction of rotation in a similar manner to the above.

After logs have been completely barked by repeating such barking steps to reciprocate them, the openable plate 41*a* is opened to discharge the barked timbers transversely.

In a barker of the type that an end plate of the receiving container 41 is formed as the openable plate 41*a*, by opening it in the final barking step, the barked timbers are discharged in turn out through one end of the receiving container 41 in the lengthwise direction thereof similarly to the conventional beating type.

The above mentioned barker is particularly fit to bark elongated logs, but it is also applicable to bark short logs for chips.

In this case, an end plate of the receiving container 41 is formed as an openable plate, and the rotary member 45 is rotated such that the barking teeth 47 serve to move the logs toward the openable plate.

Figure 22:
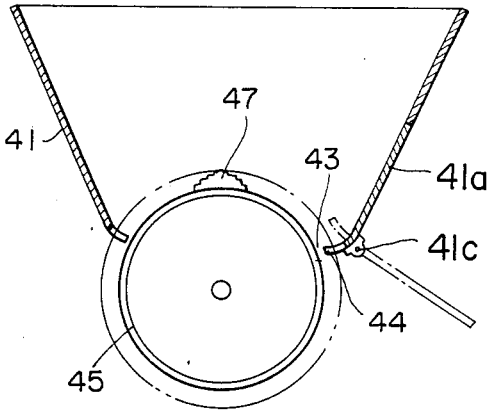

FIG. 22 shows another embodiment of the receiving container 41, in which it is tapered to widen upwardly in cress section and at least one side wall is formed to include an openable plate 41*a*. Both a pivoted part 41*c* of the openable plate 41*a* in this example and a screwed part 41*b* thereof in the foregoing example may be provided in either one of the upper and lower portions of the side wall.

Figure 24:
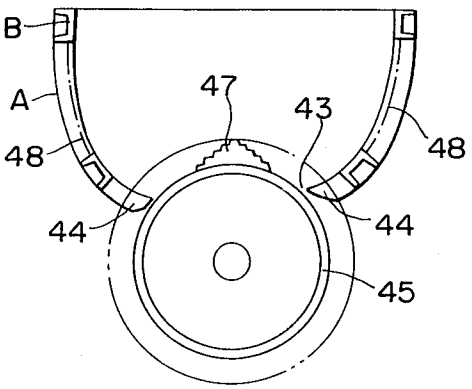
Figure 23:
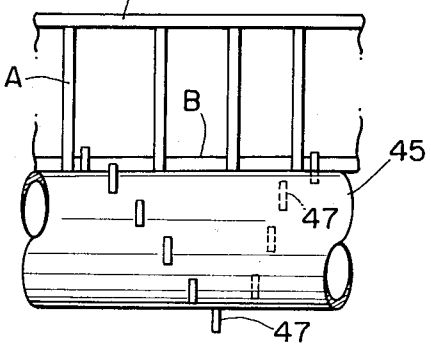

FIGS. 23 and 24 show still another embodiment of the receiving container 41 and the barking teeth 47. Each side of this receiving container 41 is composed of a number of longitudinal ribs A arranged with a spacing therebetween through which several barking teeth 47 are able to pass, and a plurality of horizontal ribs B for interconnecting those longitudinal ribs A and forming horizontal open edges of the cut-out recesses 44.

The longitudinal and horizontal ribs A, B are both of angle bars and iron plate 48 are welded to the inner surfaces of the side walls at both end portions thereof. Each of the iron plates 48 has such a horizontal width that, when one end of any log reaches the end plate of the receiving container on that side, the other end of the log will not come out of the iron plate 48 on the opposite side. Similarly to the embodiment as shown in FIG. 1, the iron plate has at the lower edge thereof a number of narrow cut-out recesses for independent passage of the respective barking teeth 47.

Even when elongated logs move in the lengthwise direction of the rotary member 45, the end of any log will not front the side walls of the receiving container 41 in the intermediate portion thereof, thus resulting in no fear that the log end may protrude to the outside even with the log being placed somewhat obliquely. The receiving container 41 composed of longitudinal and horizontal angle bars makes it possible to discharge the removed barks through a larger space with good efficiency, thereby improving the barking efficiency and reducing the cost.

Moreover, the barking teeth 47 in this embodiment are arranged on the outer circumference of the rotary member 45 in the spiral form with the plate surfaces thereof being perpendicular to the axial direction of the rotary member 45. When the rotary member 45 is intermittently driven forwardly and backwardly in such arrangement, causing the barking teeth 47 to act upon logs in both the forward and backward directions, the logs are repeatedly to move toward both ends in an alternate manner to thereby surely bark all the parts, because they are placed to take irregular attitudes, have knots or corrugated surfaces and are different from one another in their diameters.

Figure 21:
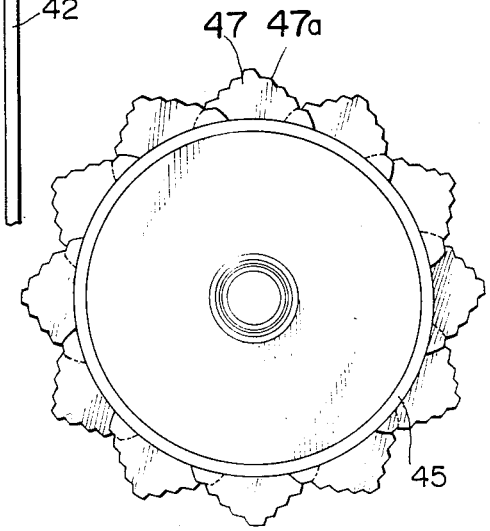

Also in the barker shown in FIGS. 20 to 22, the barking teeth 47 may be set to have their plate surfaces perpendicular to the axial direction of the rotary member 45.

Embodiment IV

This embodiment relates to a barker intended to improve the loading attitude of logs and to bark them while cutting the removed barks. Two receiving containers 51 each similar to that in Embodiment I are interconnected in series with the feeding-out side being slightly lowered. Each receiving container is formed at the bottom portion thereof with an opening 52 extending substantially over the entire length, and a hopper 53 laterally projecting is mounted a loading inlet provided on the upstream receiving container 51 at the leading end thereof. The upstream receiving member 51 may be composed of left and right side plates arranged to widen upwardly into a V shape, and front and rear end plates. Also in this case, the hopper 53 is provided at the top of the receiving container on the leading side.

The opening 52 of the receiving container 51 is displaced, as looked at in the length wide direction thereof, from the vertical center line of the receiving container 51 transversely (toward the side opposite to the hopper 53). A drum-like rotary member 55 (standard radius size of 739 mm) is rotatably supported by shafts 54 below the receiving container such that the top portion of the former enters the opening 52 of the latter. The rotary member 55 includes on the outer circumference thereof a number of barking teeth 6 having saw-like bits 6*a* (a representing a locus of rotation thereof) and welded or detachably bolted to the rotary member in the spiral form, the barking teeth 6 each having a height gradually increased in the reverse direction of rotation. The standard pitch of the teeth train is set substantially equal to or slightly longer than the length of logs, e.g., 2400 mm.

Figure 28A:
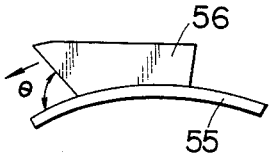
Figure 28B:
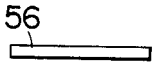
Figure 28C:
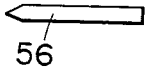
Figure 29A:
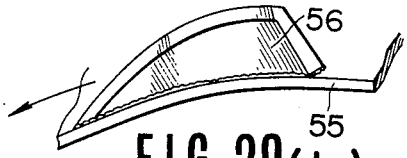
Figure 29B:
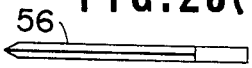
Figure 29C:
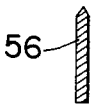

On the same circumference line as each of the barking teeth 6, there is mounted a barking cutter 56 which has a lower height of about 15–20 mm on the assumption that the barking teeth 6 has a height of about 100–120 mm. The bark cutter 56 is formed on the forward side in the direction of rotation to provide a lip angle equal to or less than 90 degrees with respect to the outer circumference of the rotary member 55 as looked at in the axial direction thereof. The forward end of the bark cutter in the direction of rotation, which provides a lip, may be formed into the face perpendicular to the plate surface of the bark cutter 56, as shown in FIG. 28(*b*). Alternatively, as shown in FIG. 28(*c*), the forward cutter end may be ground at both side edges thereof to form a lip such that the lip line locates at the depthwise center of of the bark cutter 56. Moreover, as shown in FIG. 29, the upwardly inclined portion of the barking teeth 6 may be ground at the outer circumference thereof from both sides into a mountain-like shape so as to form the lip line at the depthwise center of the teeth plate. In the example shown in FIG. 28, the lip angle $\theta$ on the forward side in the direction of rotation with respect to the circumference of the rotary member is set equal to or less than 90 degrees, and preferably in a range of 50–75 degrees when an acute angle has been selected for the lip angle $\theta$. Although a plurality of barking cutters 56 may be provided with a larger spacing than that of the barking teeth, it is desired that plural pairs of bark cutters are disposed in locations corresponding to a pair of barking teeth 6, 6 adjacent to each other through several barking teeth 6 and also substantially coinciding with each other as looked at in the axial direction of the rotary member 55. With this arrangement, the paired bark cutters 56, 56 serve to cut the long bark simultaneously with it being caught on adjacent cut-out recesses 57, 57 (later described), thereby surely cutting the bark of strong fibers.

Figure 26:
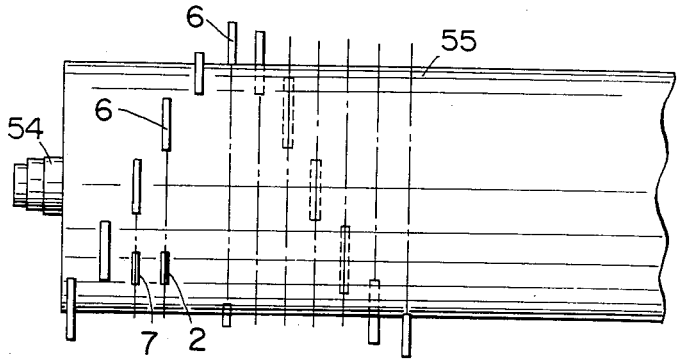

If it is so arranged that all or a part of the barking teeth 6 are inclined, as shown in FIG. 26, for the tailing side (higher side) of each tooth to deviate in the direction of traveling of logs toward the forward side, the logs can be promoted in their movements. In case that it is difficult to bark depending on the kinds of logs, cutting period or from other reasons, or that there is a small amount of logs, a shutter provided at a discharge outlet of the downstream receiving container 51 is raised by means of a motor 59 through a chain to thereby block discharge of the logs.

A lower part of the receiving container 51 on one side round the opening 52 (the side where the barking teeth 6 and the bark cutter 56 enter the receiving container 51 while rising) is inclined downwardly from a position opposite to the uppermost portion of the rotary member 55 to a position substantially equal to a level of the axis thereof, while a lower part of the receiving container on the other side is desceded while curving at a slight inclination to a location somewhat spaced outwardly from the vertical diameter of the rotary member 55. The lower parts on one side and on the other side are both formed at the lower edges thereof with a number of cut-out recesses 57 for passage of the barking teeth 6 and bark cutters 56, so that the respective barking teeth 6 and the bark cutters 56 enter the receiving container 51 through the cut-out recesses 57 formed in the steeply inclined lower part on one side and then go out through the cut-out recesses 57 formed in the lower part on the other side.

In the barker as mentioned above, when logs are loaded from the hopper 53 into the receiving container 53 by means of a loading conveyor or lift, the barking teeth 6 enter the receiving container 51 through the cut-out recesses 57 formed in the steeply inclined lower part on one side of the receiving container 51 to bark the logs while pushing up them toward the other side, during which time the rotary member 55 is rotated while supporting the logs. When the barking teeth 6 reach the lower part on the other side, they go out through the cut-out recesses 57 on that side. At this time, preceding logs are pushed by the subsequent logs to ride over the lower part on the other side and, simultaneously, sprung up by the barking teeth 6 to roll toward the lower part on one side. Such a circulation is repeated to complete the barking process.

The removed small barks are discharged to the outside through the cut-out recesses 57 by their own weight or by the sweeping action of the barking teeth 6, whereas those barks comprising long or strong fibers will still reside in the receiving container 51 as they are left in an elongated state. In this respect, the bark cutters 56 catch the elongated barks and then cut them while passing the cut-out recesses 57 with the barks being held by the edges on both sides of each cut-out recess, so that the bark cutters 56 each inclined upwardly at the depthwise center thereof force forwardly and then cut the barks while pushing up the logs. The cut barks are discharged in a twice-folded state while being caught by the bark cutters 56, or swept out through the cut-out recesses 57.

Accordingly, the barking teeth 6 function to bark logs with high efficiency without a possibility that a large amount of barks may reside in the receiving container 51.

Furthermore, the barks falling through between the cut-out recesses 57 as well as rotary member 55 and the receiving container 51 are transported out by a conveyor 61 stretched thereunder.

Figure 30A:
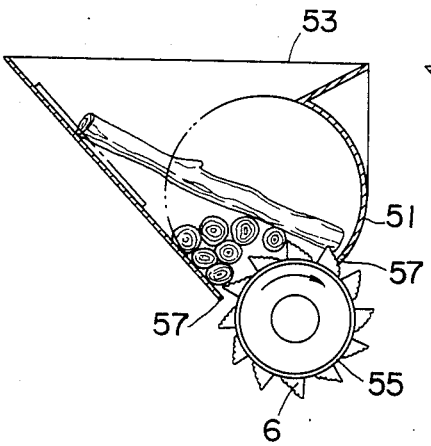
Figure 30B:
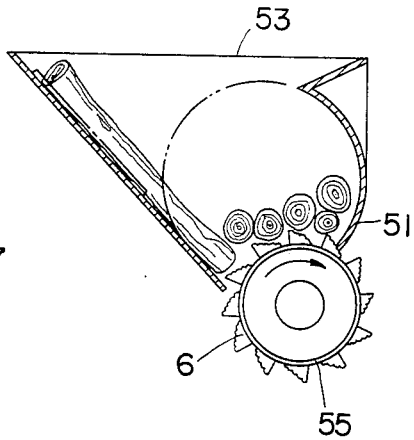

When loading logs into the hopper 53, they are loaded in parallel to the lengthwise direction of the receiving container 51, but some of them may be oftenly oriented perpendicular to the lengthwise direction of the receiving container 51 as shown in FIG. 30(*b*), or brought into an attitude obliquely crossing it. How to cope with such a condition will now be described.

Upon continuation of the barking process, some log may be come into a bridged state as shown in FIG. 30(*a*) due to the circulating action caused by rotation of the barking teeth 6, and the subsequently loaded log can not contact with the barking teeth. If the rotary member 55 is stopped at that time, the log in such a bridged state may lose its balance to be fallen sidelong. This interrupt during operation of course results in the lowered efficiency and, to find such a phenomenon, the loading condition must be monitored at all times, which is very troublesome.

Figure 25:
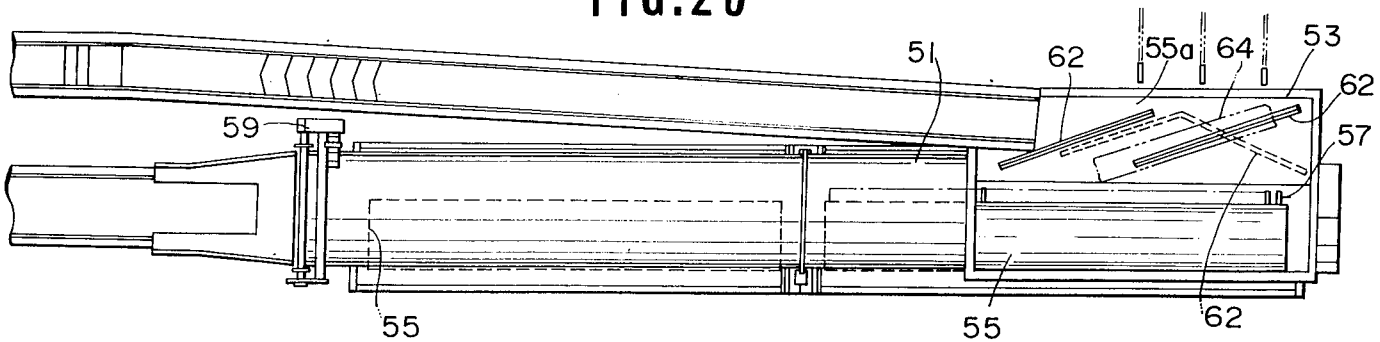

In order to prevent the above bridging phenemonon, an angle bar 62 in the inverted-V form is fixed to a sloping plate 55*a* of the hopper 53 in such a manner that it is inclined with the feeding-out side thereof being lowered as shown in FIG. 25, or that it is bent into the umbrella-like form as shown by dotted lines. With this arrangement, the log loaded perpendicularly or obliquely to the axis of the rotary member 55 strikes at the foreend thereof against the angle bar 62, so that it slides along an inclination of the bar in the lengthwise wise direction of the rotary member 55, thus coming into a proper attitude.

Figure 27:
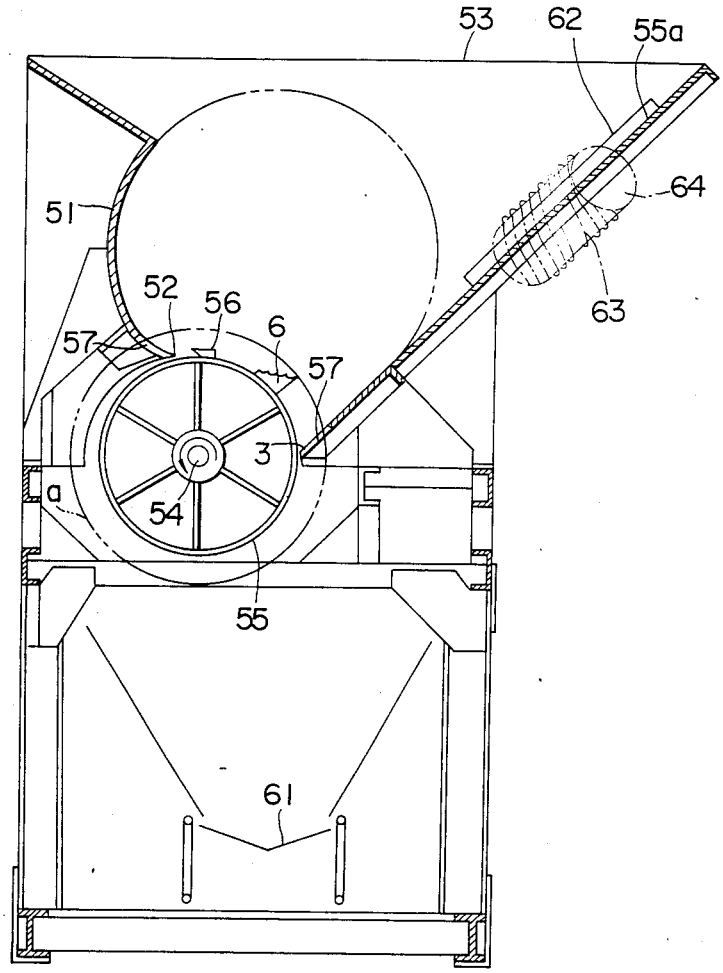

As shown by chain lines in FIGS. 25 and 27, if the angle bar 62 is replaced by a roller having spiral ribs 63 projected on the circumference thereof such that the roller 64 receives the end of the loaded log and the spiral ribs 63 serve to transfer it, it becomes possible to prevent the above mentioned sidelong falling phenomenon of logs with still higher efficiency.

It is to be noted that the rotational direction of the roller 64 is set for the the spiral ribs 63 to pick up the log, and the lead direction of the spiral ribs 63 is set to guide the end of the log toward the lowered side of the roller 64.

Embodiment V

Figure 31B:
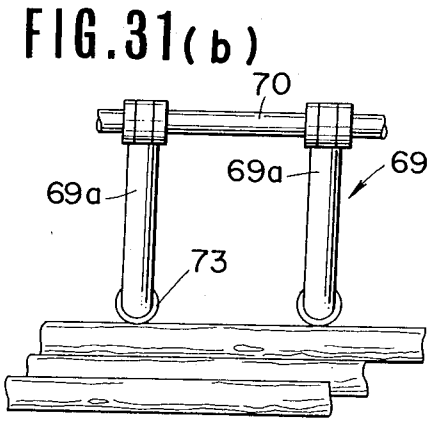
Figure 32:
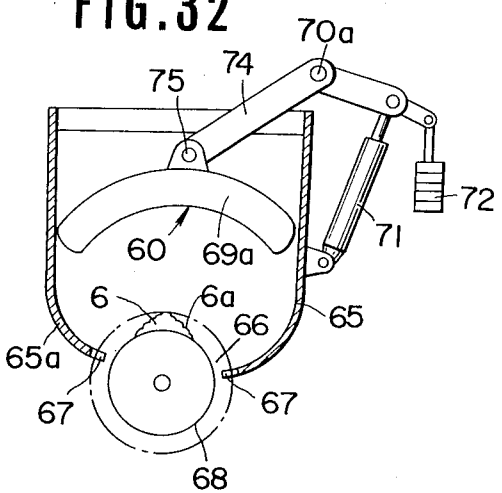
Figure 31A:
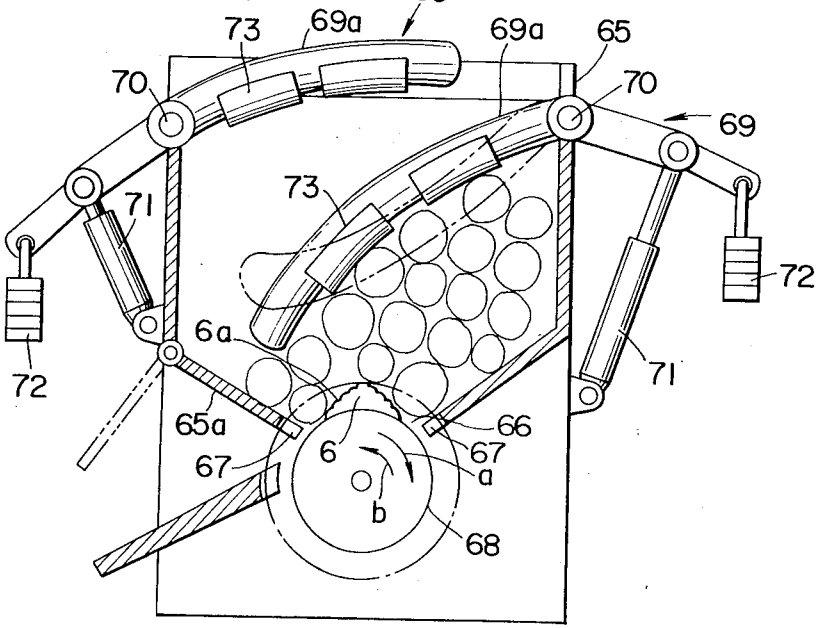

Referring now to FIGS. 31 and 32, designated at 65 is a receiving container which is substantially horizontally mounted to the body base 2, and which is formed to take a length less than two times the length of logs lumbered into pillar or plate timbers, preferably to take a length larger than that of logs in order of $\frac{1}{3}$–1/5 thereof. The receiving container 65 is formed at the bottom portion thereof with an opening 66 extending substantially over the entire length, and it is open at the top portion thereof.

As shown in FIG. 31, the lower parts of side walls of the receiving container 65 are transversely symmetrical when looked at in the lengthwise direction thereof. and are gradually curved to make narrower a spacing therebetween so as to provide the opening 66. The opening 66 includes a number of cut-out recesses 67 for independent passage of later-described barking teeth 6 therethrough.

A rotary member 68 is constituted into the form of a drum and rotatably supported causing the top portion thereof to enter the opening 66. Mountain-like barking teeth 6 each having a height gradually reduced in both the forward and backward directions of rotation are welded to or detachably screwed by means of bolts to the outer circumference of the rotary member 68 in the spiral form. Each of the barking teeth 6 has saw-like bits engraved at the outer edge thereof.

Similarly to the foregoing embodiment, the barking teeth 6 are each inclined when looked at in the direction normal to the axis of the rotary member 68, and they enter the receiving container 65 through the cut-out recesses 67 on one side and then to out to the outside through the cut-out recesses 67 on the other side.

The rotary member 68 is rotatably driven by a motor which is rotatable in both the forward and backward directions, causing logs to reciprocate in the lengthwise direction thereof while barking them. Such forward and backward rotations are switched over automatically or manually so that the motor is immediately turned forwardly or backwardly after it has been once stopped.

Furthermore, as shown in FIG. 31, at the top of the receiving container 65 on both sides thereof there are provided restriction members 69 arranged in the lengthwise direction between a spacing therebetween and each comprising two or more arms 69*a*. Each of the arms 69*a* is curved downwardly as shown by solid lines or upwardly as shown by chain lines, whereas it is rotatably supported at its proximal portion to a horizontal shaft 70 and connected at its external end to a single-acting or double-acting air cylinder 71. When the rotary member 68 is rotated clockwisely as shown by an arrow a, the right-hand air cylinders 71 are extended so that the restriction members 69 on that side are descended to press the logs. On the other hand, when the rotary member 68 is rotated counterclockwisely as shown by an arrow b, the left-hand air cylinders 71 are extended so that the restriction members 69 on that side are descended to presse the logs which have been picked up by the barking teeth 6.

Furthermore, a plurality of balance weights 72 are suspended at each outer end of the arm 69*a* so as to adjust the pressing force of the restriction member 69.

Incidentally, a plurality of rolls 73 coming into contact with the logs are rotatably supported to each of the arms 69*a*, so that the movement of logs in the lengthwise direction thereof will not be hampered.

FIG. 32 shows an another embodiment of the restriction 69, in which a support shaft 70*a* is horizontally mounted above the receiving container 65 and a plurality of pivotable arms 74 are projected from the support shaft 70*a*, each pivotable arm 74 having an arm 69*a* pivoted at its intermediate portion thereto by means of a fulcrum pin 75. With such an arrangement, when the air cylinder 71 is extended to tilt the pivotable arm 74 downwardly, each arm 69*a* presses the logs by its own weight in conformity with the circulated barking process with the air cylinder 71 being of a single-acting type. In case of a double-acting air cylinder, it becomes possible to forcibly press the logs under the substantially constant pressure, or to hold the arm 69*a* in a suspended state at a certain level in accordance with the amount of logs, thereby preventing the logs from jumping up or swelling up abnormally.

A lower part of side wall of the receiving container 65 is formed as an openable 65*a*, which is screwed at the top or bottom portion thereof to the side wall. The openable plate 65*a* is opened after completion of the barking process to discharge the barked timbers.

In the barker as mentioned above, logs of small diamter such as Japanese cedars (sugis) or white cedars (hinokis) lumbered into building materials are loaded into the receiving container 65 through the top opening by means of a loading conveyor or forklift with the rotary member 68 being rotated in either one direction, and the restriction member 69 on one side are descended in accordance with the rotational direction of the rotary member 68 in the embodiment shown in FIG. 31, or the pivotable arm 74 is tilted downwardly in the embodiment shown in FIG. 32. This causes the barking teeth 6 to enter the receiving container 65 through the cut-out recesses 67 formed in the lower part of the receiving container 65 on one side and then go out through the cut-out recesses 67 on the other side, during which time the bits 6*a* on the upstream side in the direction of rotation function to bark the logs while rolling and pushing up them toward the other side and, after passing the top of the barking teeth 6, the logs are barked by the downwardly inclined bits 6*a* on the downstream side in the direction of rotation while being descended along the teeth flank.

Reaching the other side from one side, the preceding logs are pushed up by the subsequent logs in turn to roll now back to one side, so that barking process is completed by repeating such a circulation.

During that recirculation, the deviated plate surfaces of the barking teeth 6 function to shift the logs little by little in the lengthwise direction thereof, when the end faces of logs and projections such as corrugated bark surfaces or knots strike against the barking teeth at the forward surface in the direction of rotation. Finally, the end faces of most logs come to abut with the end wall of the receiving container 65.

At that time, the motor is switched off to stop the rotary member 68 and then reversely turned to rotate the rotary member 68 also in the backward direction. Because of the mountain-like barking teeth 6, the opposite inclined bits now bark the logs while pushing up them and the opposite deviated plate surfaces function to move the logs in the reverse direction, so that the opposite end faces of logs come to abut with the other end wall of the receiving container 65. At that time, the motor is again reversed in the direction of rotation in a similar manner to the above.

After logs have been completely barked by repeating such barking steps to reciprocate them, the air cylinders 71 are operated to raise the restriction members 69 and the openable plate 65*a* is then opened to discharge the barked timbers transversely.

In a barker of the type that one end plate of the receiving container 65 is formed as the openable plate 65*a*, by opening it after completion of barking, the barked timbers are discharged in turn out through one end of the receiving container 65 in the lengthwise direction thereof similarly to the conventional beating type.

The above mentioned barker is particularly fit to bark elongated logs, but it is also applicable to bark short logs for chips. In this case, an end plate of the receiving container 65 is also formed as an openable plate, and the rotary member 68 is rotated such that the barking teeth 6 serve to transfer the logs toward the openable plate.

What is claimed is:

1. An improved barking machine, comprising:

a receiving container, fixed to a body frame, for accommodating logs, said container being formed with an opening at the bottom portion thereof, rotary members having axes of rotation disposed parallel to and below said receiving container such that the top portion of each said rotary member enters said opening, and a plurality of barking teeth, each having a height gradually increased in a direction opposite to the direction of rotation of each said rotary member, said teeth being mounted to the outer circumference of each said rotary member to bark the logs loaded in said receiving container while pushing up and rolling said logs.

2. A drum barking machine according to claim 1, wherein said opening of said receiving container includes a number of cut-out recesses for passage of said barking teeth.

3. A drum barker according to claim 1, wherein said barking teeth are each provided with saw-like bits on the face gradually increased in its height, and then detachably fixed to the outer circumference of said rotary member.

4. A barking machine according to claim 1, wherein said rotary members are disposed in front of said opening at the bottom portion of said receiving container.

5. A drum barking machine according to claim 1, wherein said barking teeth are each formed of a mountain-shaped plate, which teeth are mounted to the outer circumference of said rotary member, and said rotary member is rotated forwardly and backwardly.

6. A drum barking machine according to claim 1, wherein means for correcting the attitude of logs is provided in the log loading section of said receiving container.

7. A drum barking machine according to claim 1, wherein a pressing member for restricting the loaded logs is provided above said receiving container.

8. A barking machine according to claim 1, wherein said barking teeth are each provided with saw-like bits on the face gradually increased in its height, and permanently fixed to the outer circumference of said rotary member.

9. An improved barking machine, comprising:

a receiving container, fixed to a body frame, for accommodating logs, said container being formed with an opening at the bottom portion thereof, rotary members having axes of rotation disposed parallel to and below aid receiving container such that the top portion of each said rotary member enters said opening, and a plurality of barking teeth and bark cutters mounted to the outer circumference of said each rotary member, each of said barking teeth having a height gradually increased in a direction opposite to the direction of rotation of each said rotary member, whereby the logs loaded in said receiving container are barked while being pushed up and rolled.

10. An improved barking machine, comprising:

a receiving container, fixed to a body frame, for accommodating logs, said container being formed with an opening at the bottom portion thereof, rotary members having axes of rotation disposed parallel to and below said receiving container such that the top portion of each said rotary member enters said opening, and a plurality of barking teeth, each having a height gradually increased in a direction opposite to the direction of rotation of each said rotary member, said teeth being mounted to the outer circumference of each said rotary member, whereby the logs loaded in said receiving container are barked while at the same time being pushed up and rolled, said bottom portion of said receiving container including a number of slits formed in the lateral edge of said opening for passage of said barking teeth, and a shallow groove formed between every adjacent one of said slits, and a band fixed around said rotary member in a location corresponding to each groove so as to pass therethrough, whereby logs will be prevented from becoming entrapped between said container opening lateral edge and said rotary member.

11. A barking machine comprising:

a container for receiving logs to be barked, said container including an opening at the bottom portion thereof, at least one member having a periphery of a given radial extent, said member being supported, below said container, for rotation about an axis such that the top portion of each rotatable member enters said opening, and a plurality of barking teeth mounted on the outer periphery of each said rotatable member, each of said barking teeth having a height gradually increased in a direction opposite to the direction of rotation of each said rotatable member, whereby when logs are loaded into said container, while each of said members rotates, said teeth engage, push up, and roll said logs while simultaneously stripping bark from the logs.

12. The barking machine of claim 11, wherein each of said members comprise a cylindrical body, and said plurality of teeth are helically arranged on the outer periphery, and extend over the entire length, of said body.

13. The barking machine of claim 11, wherein said at least one rotatable member comprises two rotatable members supported end-to-end beneath said container, the bottom portion of said container defining said opening comprising opposing wall portions, at least one of said wall portions having spaced cut-outs provided along the lower region thereof for passage of the barking teeth as said rotatable members rotate.

14. The barking machine of claim 11, wherein each of said plurality of barking teeth associated with a respective one of said rotatable members are supported on a base plate mounted on said respective one of said rotatable members, and said portions of said barking teeth comprise a single unitary tooth member secured to said base plate.

15. The barking machine of claim 11, wherein each of said plurality of barking teeth associated with a respective one of said rotatable members are supported on a base plate mounted on said respective one of said rotatable members, and said portions of said barking teeth comprise individual tooth bits, each of said tooth bits being secured to said base plate.

16. The barking machine of claim 11, wherein said container includes a feed port at one side and a discharge port at an opposite side, said plurality of teeth defining means for moving said logs from said feed port to said discharge port while stripping the bark from said logs, whereby supply and discharge of logs can be carried out without interruption so that continuous barking of said logs can be accomplished.

17. The barking machine of claim 12, wherein said container includes a feed port at one side and a discharge port at an opposite side, said plurality of teeth defining means for moving said logs from said feed port to said discharge port while stripping the bark from said logs, whereby supply and discharge of logs can be carried out without interruption so that continuous barking of said logs can be accomplished.

* * * * *